US006250390B1

(12) United States Patent
Narvaez et al.

(10) Patent No.: US 6,250,390 B1
(45) Date of Patent: Jun. 26, 2001

(54) DUAL ELECTRIC SUBMERGIBLE PUMPING SYSTEMS FOR PRODUCING FLUIDS FROM SEPARATE RESERVOIRS

(75) Inventors: Diego Narvaez; Olegario Rivas; Robert P. Fielder; Kevin T. Scarsdale, all of Bartlesville, OK (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/225,045

(22) Filed: Jan. 4, 1999

(51) Int. Cl.[7] ..... E21B 43/00
(52) U.S. Cl. ..... 166/369; 313/54.1; 313/66.4
(58) Field of Search ..... 166/313, 369, 166/105, 106, 66.4, 54.1

(56) References Cited

U.S. PATENT DOCUMENTS

| | | | | |
|---|---|---|---|---|
| 3,765,483 | | 10/1973 | Vencil | 166/265 |
| 4,440,221 | * | 4/1984 | Taylor et al. | 166/106 |
| 4,611,656 | * | 9/1986 | Kendall, Jr. et al. | 166/65.1 |
| 4,621,689 | * | 11/1986 | Brookbank, III | 166/106 |
| 4,682,655 | | 7/1987 | Rivas | 166/369 |
| 5,293,931 | * | 3/1994 | Nichols et al. | 166/54.1 |
| 5,404,943 | * | 4/1995 | Strawn | 166/54.1 |
| 5,611,397 | * | 3/1997 | Wood | 166/68 |
| 5,875,852 | * | 3/1999 | Floyd et al. | 166/387 |
| 5,881,814 | * | 3/1999 | Mills | 166/313 |
| 5,934,375 | * | 8/1999 | Peterson | 166/264 |
| 5,954,136 | * | 9/1999 | McHugh et al. | 166/384 |
| 5,979,559 | * | 11/1999 | Kennedy | 166/369 |
| 6,006,837 | * | 12/1999 | Breit | 166/302 |

FOREIGN PATENT DOCUMENTS

| | | | |
|---|---|---|---|
| 0 922 835 | 6/1999 | (EP) | E21B/43/14 |
| WO 98/37307 | 8/1998 | (WO) | E21B/43/38 |

* cited by examiner

*Primary Examiner*—Victor Batson
(74) *Attorney, Agent, or Firm*—Fletcher, Yoder & Van Someren

(57) ABSTRACT

A dual submergible pumping system permits pumping of fluids from separate zones within a narrowly confined wellbore without commingling of fluids. The system includes a single deployment tubing from which a first and second submergible pumping system are suspended. The system further includes a fluid transport system having one fluid flow path defined by the hollow interior of the deployment tubing and a second fluid flow path isolated from the first flow path.

17 Claims, 4 Drawing Sheets

DUAL ELECTRIC SUBMERGIBLE PUMPING SYSTEMS FOR PRODUCING FLUIDS FROM SEPARATE RESERVOIRS

FIELD OF THE INVENTION

The present invention relates generally to systems for raising fluids from wells, and particularly to a dual submergible pumping system for use in a narrowly confined wellbore to produce fluids from separate reservoirs without commingling of the fluids.

BACKGROUND OF THE INVENTION

In producing petroleum and other useful fluids from production wells, it is generally known to provide a submergible pumping system for raising the fluids collected in a well. Production fluids enter a wellbore via perforations formed in a well casing adjacent a production formation. Fluids contained in the formation collect in the wellbore and may be raised by the submergible pumping system to another zone or to a collection point above the surface of the earth.

In an exemplary submergible pumping system, the system includes several components, such as a submergible pump, a submergible electric motor and a motor protector. The submergible electric motor typically supplies power to the submergible pump by a drive shaft, and the motor protector serves to isolate the internal motor oil from the well fluids. A deployment system, such as deployment tubing in the form of coiled tubing or production tubing, is used to deploy the submergible pumping system within a wellbore. Generally, power is supplied to the submergible electric motor or motors by one or more power cables supported along the deployment system.

Some wells have the capability of producing from two or more zones or reservoirs. However, because of constraints such as incompatibility of fluids, differential pressures in the reservoirs, and other constraints, it is sometimes undesirable to commingle the fluids produced from separate production zones.

Production from the separate zones or reservoirs can be accomplished by running separate submergible pumping systems deployed on separate tubing strings. This can be problematic in certain applications, however, due to space constraints. In other words, the wellbore must be of substantial diameter to accommodate two separate systems. Many of the common or standard wellbore diameters do not readily accommodate the use of independently deployed submergible pumping systems.

Thus, it would be advantageous to have a dual submergible pumping system that could be deployed on a single tubing deployment system within a narrowly confined wellbore. It would also be advantageous to utilize separate fluid flow paths to prevent commingling of fluids pumped from the separate zones.

SUMMARY OF THE INVENTION

The present invention features a pumping system for use in a wellbore. The system comprises a deployment tubing, a first submergible pumping system suspended from the deployment tubing and a second submergible pumping system suspended from the deployment tubing. Additionally, the system includes a fluid transport having a first fluid flow path and a second fluid flow path separated from the first fluid flow path. The first submergible pumping system is connected to the fluid transport such that fluid may be discharged into the first fluid flow path, and the second submergible pumping system is connected to the fluid transport such that fluid may be discharged into the second fluid flow path.

According to another aspect of the invention, a dual electric submergible pumping system is provided for interaction with at least two separate zones within a wellbore. The system includes a single deployment tubing having a hollow interior through which a fluid may be pumped. Additionally, a dual submergible pumping system is suspended from the single deployment tubing. The dual pumping system has a first submergible pump connected to a first pump intake disposed in a first zone as well as a second submergible pump connected to a second pump intake disposed in a second zone. The dual system also includes an alternate fluid transport. The first submergible pump is disposed in fluid communication with the hollow interior, while the second submergible pump is disposed in fluid communication with the alternate fluid transport.

According to another aspect of the present invention, a method is provided for pumping fluids from a pair of zones within a narrowly confined wellbore without commingling the fluids pumped from the individual zones. The method includes separating a first wellbore zone from a second wellbore zone by a packer. The method further comprises suspending a first and a second pump from a deployment tubing having a hollow interior, and drawing fluid into the first pump from the first wellbore zone while drawing fluid into the second pump from the second wellbore zone. Additionally, the method includes pumping fluid from the first pump along a first fluid flow path within the hollow interior, and pumping fluid from the second pump along a second fluid flow path isolated from the first fluid path.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
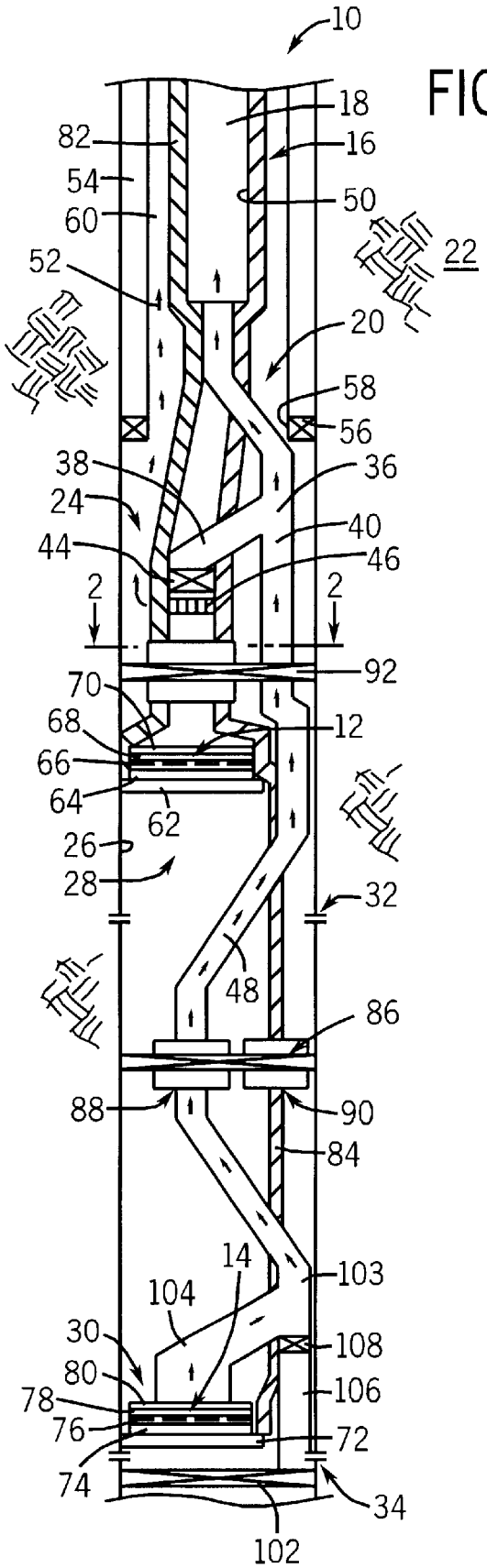
FIG. 1 is a front elevational view of a dual submergible pumping system positioned in a wellbore, according to a preferred embodiment of the present invention.

Referring generally to FIG. 1, a dual submergible pumping system 10 is illustrated according to a preferred embodiment of the present invention. System 10 may comprise a variety of components depending on the particular application or environment in which it is used. However, system 10 typically includes a first submergible pumping system 12 and a second submergible pumping system 14. First submergible pumping system 12 and second submergible pumping system 14 are deployed from a single deployment system 16, such as deployment tubing 18, e.g. production tubing or coiled tubing.

System 10 is designed for deployment in a well 20 within a geological formation 22 containing desirable production fluids, such as petroleum. Typically, a wellbore 24 is drilled into geological formation 22 and lined with a wellbore casing 26.

In the embodiment illustrated, system 10 is utilized to pump fluids from different zones, specifically a first zone or reservoir 28 and a second zone or reservoir 30. In this exemplary embodiment, first zone 28 is vertically above second zone 30 along wellbore 24. Furthermore, a first set of perforations 32 is disposed through wellbore casing 26 to permit a fluid to flow into wellbore 24 at first zone 28. Similarly, a second set of perforations 34 is formed through wellbore casing 26 to permit a fluid to flow into wellbore 24 at second zone 30. The overall system 10 is designed to transport or move the fluid flowing into wellbore 24 at first zone 28 without commingling that fluid with the fluid flowing into wellbore 24 at second zone 30. Thus, fluid from first zone 28 and fluid from second zone 30 can be transported, e.g. pumped to the surface of the earth, independently of each other.

As illustrated, an upper Y-tool 36 is connected to the lower end of deployment tubing 18. Upper Y-tool 36 splits into a first channel 38 from which first submergible pumping system 12 is suspended, and a second channel 40 from which second submergible pumping system 14 is suspended. Second channel 40 is routed along the side of first submergible pumping system 12, through first zone 28 and into second zone 30, where it is coupled to second submergible pumping system 14. First channel 38 is plugged by a plug 44 and includes a perforated discharge joint 46 disposed between plug 44 and first submergible pumping system 12.

In operation, second submergible pumping system 14 draws fluid from second zone 30 and discharges it into second channel 40 so that the fluid may be transported along a fluid flow path 48 defined by second channel 40 and deployment tubing 18. Specifically, deployment tubing 18 includes a hollow interior 50 through which the fluid from second zone 30 is pumped.

Simultaneously, first submergible pumping system 12 draws a fluid from first zone 28 and discharges it through perforated discharge joint 46 into wellbore 24 and, specifically, into the annulus formed about deployment system 16. Thus, the fluid from first zone 28 may be pumped along a fluid flow path 52 completely isolated from fluid flow path 48.

Often, it is desirable to minimize the exposure of wellbore casing 26 to produced fluid. Accordingly, a flow liner 54 may be deployed along the interior of wellbore casing 26 to isolate at least a substantial portion of wellbore casing 26 from the produced fluid. Typically, flow liner 54 is held in place along wellbore casing 26 by a packer 56 having an appropriate opening 58 through which fluid may flow along fluid flow path 52. In this arrangement, a fluid transport is formed in an annulus 60 disposed between flow liner 54 and deployment system 16.

Submergible pumping systems 12 and 14 may include a variety of components, depending on the specific environment in which dual submergible pumping system 10 is deployed. However, an exemplary first submergible pumping system 12 includes an electric motor 62, a motor protector 64, a pump intake 66, a submergible pump 68 and a connector 70 by which the pumping system is connected to first channel 38. Similarly, an exemplary second submergible pumping system 14 includes a submergible electric motor 72, a motor protector 74, a pump intake 76, a submergible pump 78 and a connector 80 by which the system is connected to second channel 40. Additionally, a first power cable 82 supplies electric power to motor 62 and a second power cable 84 supplies electric power to motor 72. It should be noted that the submergible pumping system components are diagrammatically illustrated in a compressed form.

Other exemplary features of dual submergible pumping system 10 include an intermediate multiple bore packer 86 that separates first zone 28 from second zone 30. Packer 86 includes an opening 88 through which second channel 40 extends and an opening 90 through which power cable 84 extends to second submergible pumping system 14.

Figure 2:
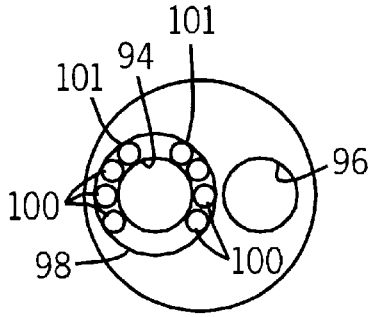
FIG. 2 is a cross-sectional view taken generally along line 2—2 of FIG. 1.

Additionally, an upper packer 92 is disposed intermediate first submergible pumping system 12 and perforated discharge joint 46 to prevent fluid moving along fluid flow path 52 from settling back into first zone 28. Upper packer 92 includes an opening 94, through which first channel 38 extends, and an opening 96, through which second channel 40 extends. Also, upper packer 92 preferably includes a collar 98 through which individual conductors 100 of power cables 82 and 84 extend, as best illustrated in the cross-sectional view of FIG. 2. Collar 98 may also accommodate a fluid injection tube 101, through which chemicals, such as corrosion inhibitors, may be injected.

Optionally, a permanent packer 102 may be used at a position beneath submergible pumping system 14. If packer 102 is utilized, second channel 40 preferably includes second Y-tool 103. Y-tool 103 comprises a first branch 104 coupled to second submergible pumping system 14 to complete fluid flow path 48. Also, Y-tool 103 includes a second branch 106 that is used as a seating tube against permanent packer 102. Second branch 106 is plugged by an appropriate plug 108.

In the illustrated embodiment, first zone 28 is isolated between upper packer 92 and intermediate packer 86. Similarly, second zone 30 is isolated between intermediate packer 86 and permanent packer 102. With this arrangement, not only can fluids be independently pumped from first zone 28 and second zone 30, but fluid also may be injected. For example, a fluid can be pumped from zone 28 while another fluid is injected into zone 30 and vice versa. Also, independent pressurized fluids could be injected into both zones 28 and 30.

In the illustrated embodiment, first submergible pumping system 12 is generally axially aligned with second submergible pumping system 14 at a position vertically above second submergible pumping system 14. The unique arrangement of dual system 10 permits this efficient use of space and allows the pumping of fluids from or into independent wellbore zones without commingling of the fluids moved into or out of the respective zones.

The design illustrated in FIG. 1 potentially may be modified by extending first channel 38 downwardly and shortening second channel 40, such that submergible pumping system 14 is disposed above submergible pumping system 12 within wellbore 24. In this latter arrangement system 14 is positioned alongside first channel 38 and, typically, is not axially aligned with system 12. Furthermore, packer 92 can be disposed above Y-tool 36. In this embodiment, the fluids from channels 38 and 40 are discharged into concentric tubes. The discharge from channel 38 flows into the center tube while the discharge from channel 40 flows into the annulus formed between the center tube and the inside wall of the outer tube. With this arrangement, independent fluid flow paths are maintained through a single flow passage in upper packer 92. Preferably, the flow from the center tube is diverted to the annulus 60 and the flow from the annulus, formed between the center tube and outer tube, is directed into tubing 18 by virtue of a discharge crossover head. In other words, the discharge crossover head is used in place of perforated discharge joint 46.

Also, by placing submergible pumping system 14 above submergible pumping 12, the fluid from first zone 28 is pumped through tubing 18 along flow path 48. The fluid from second zone 30, on the other hand, is pumped through the annulus formed around tubing 18 along fluid flow path 52.

Figure 3:
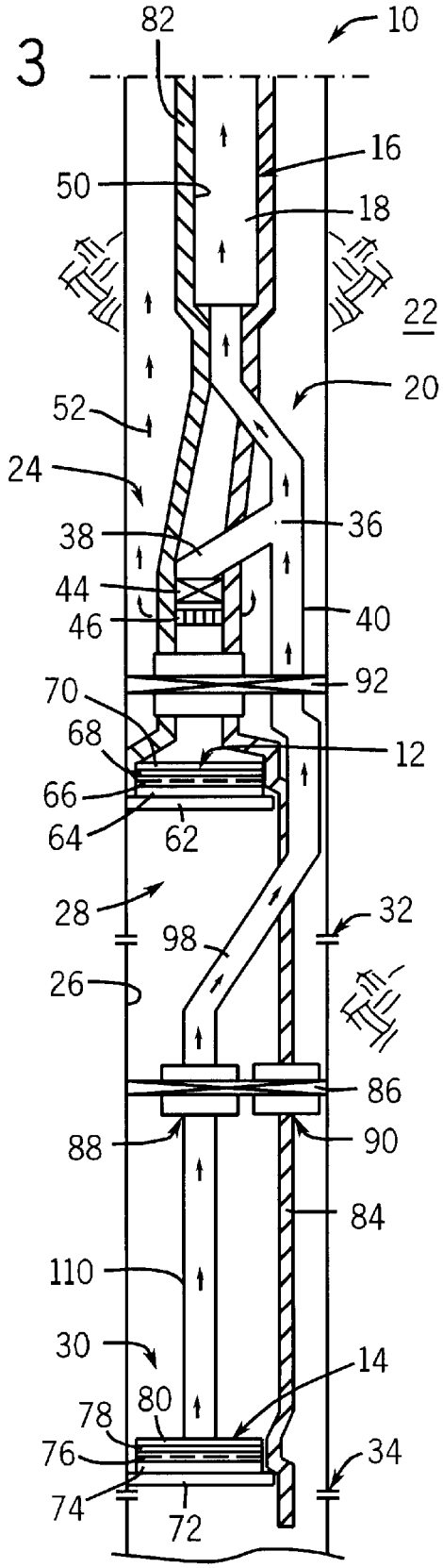
FIG. 3 is a front elevational view of an alternate embodiment of the dual submergible pumping system illustrated in FIG. 1.

Referring now to FIG. 3, a modified embodiment of the dual submergible pumping system is illustrated. This embodiment is similar to that described with reference to FIG. 1, but it includes a single channel section 110 in place of second Y-tool 103. Section 110 completes the portion of second channel 40 between intermediate packer 86 and second submergible pumping system 14.

Additionally, permanent packer 102 is omitted, as is possible when simply pumping fluids from second wellbore zone 30. Furthermore, flow liner 54 is removed to illustrate use of the present dual system in an environment where a produced fluid may be pumped upwardly between the deployment system 16 and the wellbore casing 26.

Figure 4:
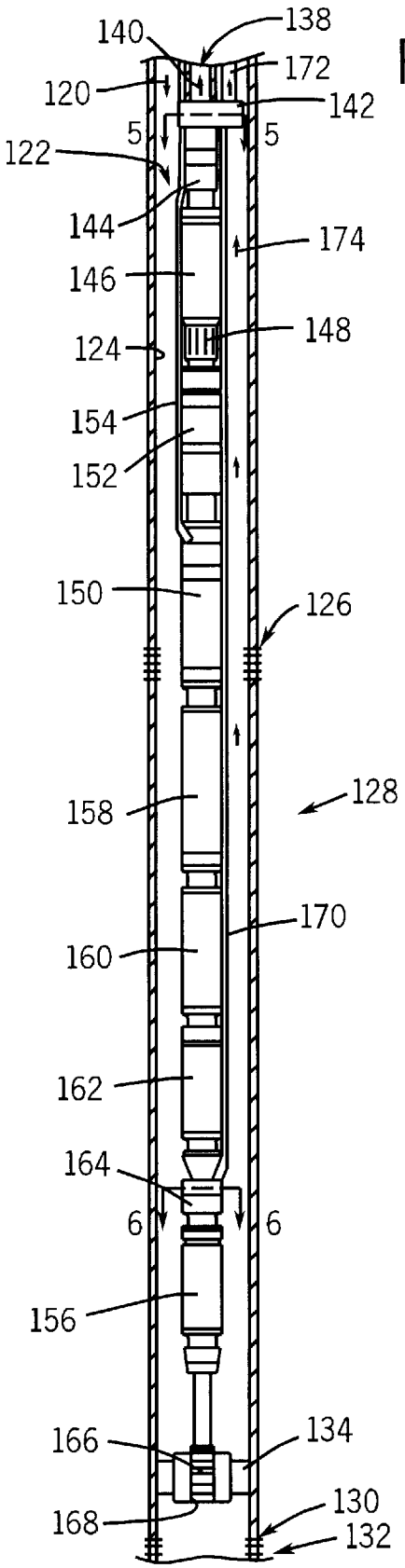
FIG. 4 is a front elevational view of an alternate embodiment of the dual submergible pumping system illustrated in FIG. 1.
Figure 5:
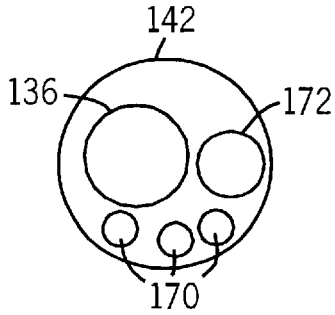
FIG. 5 is a cross-sectional view taken generally along line 5—5 of FIG. 4.
Figure 6:
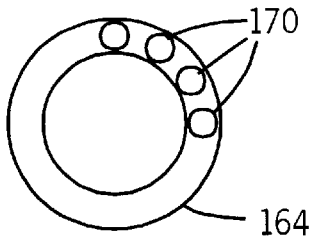
FIG. 6 is a cross-sectional view taken generally along line 6—6 of FIG. 4.

Another embodiment of the dual submergible pumping system 10 is illustrated in FIGS. 4–6. In this embodiment, a dual submergible pumping system 120 is disposed in a wellbore 122 lined by a wellbore casing 124.

Wellbore casing 124 includes a plurality of perforations 126 through which a fluid may enter wellbore 122 at a first zone 128. Similarly, wellbore casing 124 includes an additional set of perforations 130 disposed through wellbore casing 124 at a second zone 132. A packer 134 separates zone 128 from zone 132.

In this embodiment, system 120 includes a single deployment tubing 136, such as production tubing or coiled tubing. Deployment tubing 136 includes a hollow interior 138 that forms a fluid flow path 140.

Deployment tubing 136 extends through a manifold 142 and is engaged with a connector 144. Connector 144 is connected to an upper pump 146, such as a submergible, centrifugal style pump used in pumping wellbore fluids. Upper pump 146 includes a pump intake 148 disposed in first zone 128.

A submergible electric motor 150 is coupled to pump 146 to provide power to upper pump 146. A motor protector 152 is disposed between pump 146 and submergible electric motor 150. Also, a power cable 154 provides electric power to motor 150.

Preferably, motor 150 also is coupled to a second or lower pump 156 to provide power thereto in addition to powering upper pump 146. Power is transferred from the motor to the pumps by a drive shaft (not shown), as is known to those of ordinary skill in the art. If additional power is required to run both upper pump 146 and lower pump 156, additional motors, such as optional motors 158 and 160 may be added. Preferably, a second motor protector 162 is attached to the lowermost motor 150, 158 or 160, to isolate the internal motor oil from the wellbore fluids.

In the illustrated embodiment, lower pump 156 is connected to lower protector 162 by a discharge head 164. Additionally, lower pump 156 includes a pump intake 166 disposed in fluid communication with second zone 132. By way of example, pump intake 166 may be disposed in an opening 168 formed through packer 134.

At least one conduit and preferably a plurality of conduits 170 are connected between discharge head 164 and manifold 142. Exemplary conduits 170 comprise one half or three quarter inch tubing. The conduits are placed in fluid communication with a larger fluid transport tube 172, e.g. coiled tubing, at manifold 142. Thus, conduits 170, in combination with manifold 142 and fluid transport tube 172, comprise an independent, alternate fluid transport that forms a fluid flow path 174, wholly isolated from fluid flow path 140.

In operation, motors 150, 158 and 160 power upper pump 146 and lower pump 156. Upper pump 146 draws a fluid from first zone 128 through pump intake 148 and discharges the fluid through hollow interior 138 of deployment tubing 136 along fluid flow path 140. Similarly, lower pump 156 draws a fluid from second zone 132 and discharges it through discharge head 164, shown in cross-section in FIG. 6. The discharged fluid travels along fluid flow path 174 through conduits 170 and into manifold 142, shown in cross-section in FIG. 5. Within manifold 142, the discharged fluid moves into fluid communication with fluid transport tube 172 and continues along fluid flow path 174 completely isolated from fluid flow path 140.

In the illustrated embodiment, upper pump 146 typically has a higher flow rate than lower pump 156. The conduits 170, as well as fluid transport tube 172, tend to be smaller in diameter than deployment tubing 136, and therefore have less flow capacity than deployment tubing 136. Thus, in some applications, it may be desirable to power lower pump 156 independently of upper pump 146. In this event, at least one motor, such as motor 160, is powered by a separate power cable (not shown) and run independently of the motors providing power to upper pump 146.

The configuration of the various components of system 120 allow upper pump 146 and lower pump 156 to be disposed generally in axial alignment with one another within wellbore 122. This configuration facilitates efficient use of the narrowly confined space within wellbore 122, while permitting production of fluid from two separate zones. The use of independent conduits 170, manifold 142 and fluid transport tube 172 ensures that fluids from separate zones in wellbore 122 are prevented from commingling during production.

Figure 7:
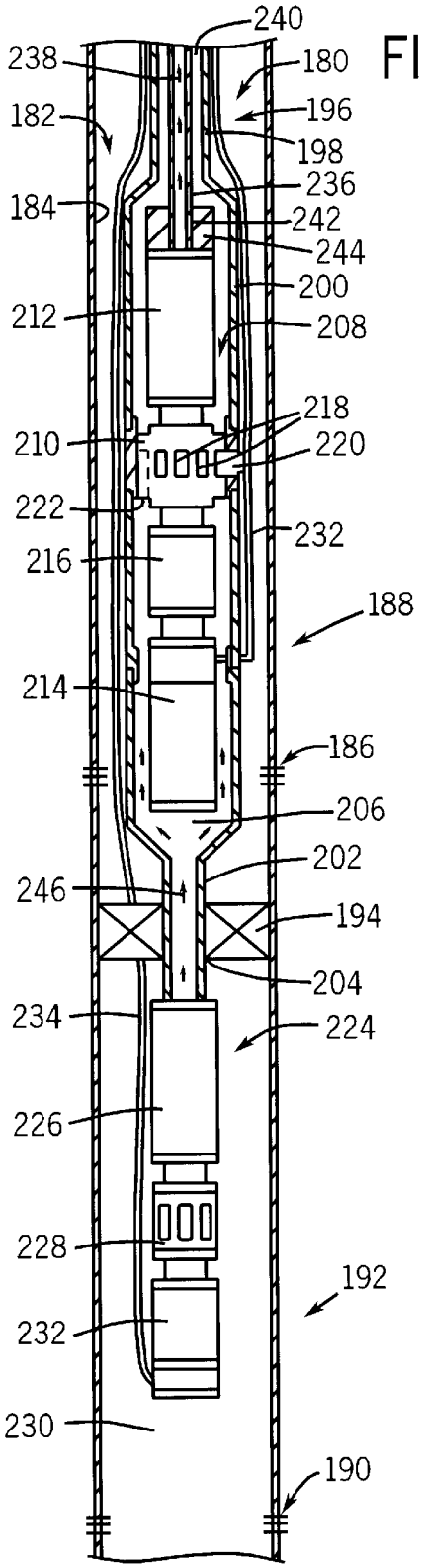
FIG. 7 is front elevational view of an alternate embodiment of the system illustrated in FIG. 1.

Referring now to FIG. 7, another embodiment of the dual submergible pumping system is illustrated. In this embodiment, a dual submergible pumping system 180 is shown disposed within a wellbore 182 that is lined by a wellbore casing 184. Wellbore casing 184 includes a first perforation region 186 that permits fluid to flow into wellbore 182 at a first zone 188. Similarly, a second perforation region 190 permits fluid to flow into wellbore 182 at a second zone 192. First zone 188 and second zone 192 are separated by a packer 194.

In this embodiment, a deployment system 196, such as tubing 198, is connected to an expanded housing 200. Expanded housing 200 is connected and sealed to a lower end of tubing 198. At an opposite end from tubing 198, expanded housing 200 joins a narrowed tubular section 202 that extends through an opening 204 of packer 194.

Expanded housing 200 includes a hollow interior 206 sized to receive a submergible pumping system 208. Submergible pumping system 208 is mounted to expanded housing 200 by a manifold 210. Manifold 210 can be mounted to housing 200 by an appropriate mounting fixture or fasteners.

An exemplary submergible pumping system 208 includes a submergible pump 212 coupled to a submergible motor 214. A motor protector 216 is disposed between submergible pump 212 and submergible motor 214. Also, manifold 210 is located between pump 212 and protector 216 and serves as a pump intake. Manifold 210 includes a plurality of inlets 218 that cooperate with openings 220 through expanded housing 200 to draw fluid from first zone 188. Additionally, manifold 210 includes at least one generally axial opening 222 through which fluid may flow along the interior of housing 200, while avoiding commingling with the fluid intaken through inlets 218 from first zone 188.

A second submergible pumping system 224 is connected to tubular section 202. An exemplary submergible pumping system 224 includes a pump 226 connected to a pump intake 228 disposed in second zone 192. Additionally, an electric motor 230 provides power to pump 226, and a motor protector 232 isolates the interior of motor 230 from the wellbore fluids of second zone 192. Each of the electric motors 214 and 230 receive electrical power via corresponding power cables 232 and 234, respectively.

In operation, submergible pumping system 208 draws a fluid from first zone 188 through fluid inlets 218 and discharges the fluid into a conduit 236 coupled to submergible pump 212. Conduit 236 defines a fluid flow path 238 along which fluid is produced from first zone 188. Preferably, conduit 236 is sized to fit within a hollow interior 240 of tubing 198. Conduit 236 may include a nipple 242 designed for insertion into a receiving structure 244 attached to submergible pump 212. Thus, conduit 236 can be inserted or removed after deployment of the remainder of dual submergible pumping system 180 in wellbore 182.

Second submergible pumping system 224 draws fluid from second zone 192 through pump intake 228. Pump 226 discharges the fluid from second zone 192 into tubular section 202 along an independent fluid flow path 246. The fluid from second zone 192 flows along fluid flow path 246 upwardly through the annulus formed between submergible pumping system 208 and expanded housing 200. The fluid continues to flow upwardly through manifold 212 and ultimately into the annulus formed between conduit 236 and tubing 198. Thus, the fluid produced from second zone 192 is isolated from the fluid produced from first zone 188 as the fluids flow upwardly to a desired location.

Certain modifications also may be made to system 180. For example, if it becomes unnecessary to separate the fluids produced from the distinct zones, conduit 236 can be removed and both submergible pumping systems can produce fluid into the same hollow interior of tubing 198. Additionally, one or more packers may be added above manifold 210 or below pump intake 228 to permit injection of fluid into a given zone rather than removal. The use of additional packers allows the subject zones to receive pressurized fluid, as is sometimes desirable in certain production applications.

Figure 8:
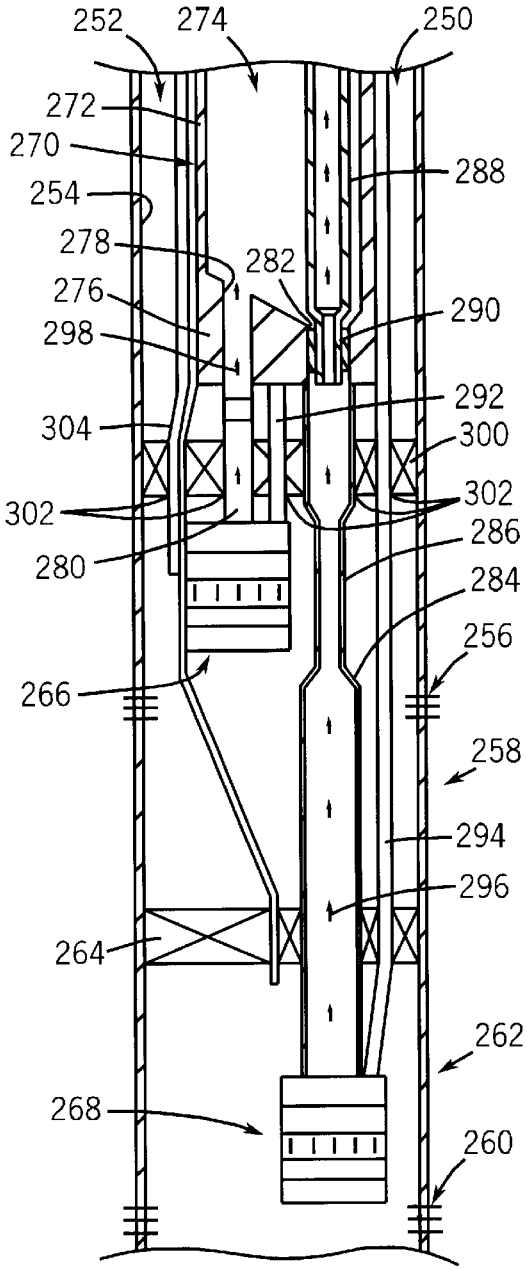
FIG. 8 is another alternate embodiment of the dual submergible pumping system illustrated in FIG. 1.

Referring generally to FIG. 8, another embodiment of the dual submergible pumping system is illustrated according to a preferred embodiment of the present invention. In this embodiment, a dual submergible pumping system 250 is shown disposed within a wellbore 252 that is lined with a wellbore casing 254. Wellbore casing 254 includes a perforated region 256 that permits fluid to flow into wellbore 252 at a first zone 258. Similarly, wellbore casing 254 includes a second perforated region 260 through which a fluid may flow into wellbore 252 at a second zone 262. Zone 258 and zone 262 are separated by a packer 264.

System 250 includes a first electric submergible pumping system 266 and a second electric submergible pumping system 268. System 266 is disposed to intake a fluid from zone 258, while system 268 is disposed to intake a fluid from zone 262.

Both of the submergible pumping systems 266 and 268 are suspended from a deployment system 270 that comprises a deployment tubing 272 having a hollow interior 274. Deployment system 270 also includes a parallel flow head 276 connected to a lower end of tubing 272. Parallel flow head 276 comprises an opening 278 to which submergible pumping system 266 is engaged to provide fluid communication with hollow interior 274 via a conduit 280.

Parallel flow head 276 also includes an additional opening 282 to which submergible pumping system 268 is engaged via an appropriate conduit 284. Conduit 284 preferably comprises a tube that extends through packer 264 to submergible pumping system 268. If space constraints require, conduit 284 may be designed with a narrowed section 286 along submergible pumping system 266 to provide adequate clearance.

Opposite conduit 284, a tube 288 is sealed to parallel flow head 276 at opening 282. Tube 288 is placed in fluid communication with conduit 284 for producing fluid from zone 262. Preferably, tube 288 extends through hollow interior 274 of deployment tubing 272. Also, tube 288 may include an engagement nipple 290 designed for selective engagement with parallel flow head 276. Nipple 290 permits insertion and removal of tube 288 following deployment of the submergible pumping systems 266 and 268 in wellbore 252.

Each submergible pumping system 266 and 268 may include a variety of components, but typically include submergible pumps, submergible motors, motor protectors and pump intakes, as disclosed with respect to the embodiments described above. Similarly, electrical power is supplied to submergible pumping systems 266 and 268 by appropriate power cables 292 and 294, respectively.

In operation, submergible pumping system 268 draws fluid from zone 262 and discharges it through conduit 284 and tube 288 along a fluid flow path 296. Simultaneously, submergible pumping system 266 draws fluid from zone 258 and discharges it through conduit 280 and into hollow interior 274 of deployment tubing 272 along a fluid flow path 298. Thus, the fluid drawn from zone 258 is produced along an independent flow path relative to the fluid drawn from zone 262.

Additional features of dual submergible pumping system 250 include an upper packer 300 having a plurality of bores 302 through which conduits 280 and 284, power cables 292 and 294 and a plurality of optional injection lines 304 extend. Packer 300 allows pressurized fluid to be injected into zone 258, in lieu of pumping fluid from zone 258.

Injection lines 304 typically are used to inject fluids, such as corrosion inhibitors, into the fluids being produced from each of the respective zones. In any of the embodiments described above, injection lines, such as injection lines 304, can be incorporated into the design either independently or in combination with the power cables, as is known to those of ordinary skill in the art.

It will be understood that the foregoing description is of preferred embodiments of this invention, and that the invention is not limited to the specific forms shown. For example, a variety of additional submergible pumping system components can be incorporated into the design; a variety of packers may be used if it is necessary to alternate between production from a zone and injection of fluid into that zone; a variety of control lines, such as fluid control lines, optical fibers and conductive control lines can be incorporated into the overall system; and different diameters and sizes of the tubing and other components can be selected as required or desired for a specific application. Additionally, use of the terms "first" and "second" throughout this disclosure is for aiding in description of the overall system, and should not be construed as requiring a specific orientation or arrangement of components. These and other modifications may be made in the design and arrangement of the elements without departing from the scope of the invention as expressed in the appended claims.

What is claimed is:

1. A pumping system for use in a wellbore, comprising:

a deployment tubing;

a first electric submergible pumping system suspended from the deployment tubing;

a second electric submergible pumping system suspended from the deployment tubing; and a fluid transport system having a first fluid flow path and a second fluid flow path separated from the first fluid flow path, wherein the first submergible pumping system is connected to the fluid transport system such that a first fluid may be discharged into the first fluid flow path and the second submergible pumping system is connected to the fluid transport system such that a second fluid may be discharged into the second fluid flow path, wherein the first fluid flow path is defined by an annulus formed between the deployment tubing and a well casing liner and the second fluid flow path is defined by a hollow interior of the deployment tubing.

2. The pumping system as recited in claim 1, wherein the deployment tubing comprises a coiled tubing.

3. The pumping system as recited in claim 1, wherein the deployment tubing comprises a string of production tubing.

4. The pumping system as recited in claim 1, wherein the first submergible pumping system is deployed above the second submergible pumping system when disposed within the wellbore.

5. The pumping system as recited in claim 4, further comprising a packer disposed between the first submergible pumping system and the second submergible pumping system.

6. The pumping system as recited in claim 5, further comprising a second packer disposed above the first submergible pumping system.

7. The pumping system as recited in claim 6, further comprising a flow liner disposed along an inside surface of a wellbore casing to isolate the wellbore casing.

8. A dual electric submergible pumping system for interaction with at least two separate zones within a wellbore, comprising:

a single deployment tubing having a hollow interior through which a fluid may be pumped;

a dual electric submergible pumping system suspended from the single deployment tubing, the dual submergible pumping system having a first submergible pump connected to a first pump intake disposed in a first zone and a second submergible pump connected to a second pump intake disposed in a second zone, wherein the first submergible pump is disposed in fluid communication with the hollow interior, and an alternate fluid transport, comprising an annulus formed around the single deployment tubing, wherein the second submergible pump is disposed in fluid communication with the alternate fluid transport.

9. The dual electric submergible pumping system as recited in claim 8, wherein the alternate fluid transport comprises a tube.

10. The dual electric submergible pumping system as recited in claim 9, wherein the tube is disposed within the hollow interior.

11. The dual electric submergible pumping system as recited in claim 8, further comprising a first submergible motor coupled to the first submergible pump and a second submergible motor coupled to the second submergible pump.

12. The dual electric submergible pumping system as recited in claim 8, wherein a packer is disposed between the first zone and the second zone.

13. The dual electric submergible pumping system as recited in claim 8, further comprising a liner that defines the annulus.

14. A method for pumping fluids from a pair of zones within a narrowly confined wellbore without commingling the fluids pumped from individual zones, comprising:

separating a first wellbore zone from a second wellbore zone by a packer;

suspending an electric submersible pumping system having a first pump and a second pump from a deployment tubing having a hollow interior;

drawing fluid into the first pump from the first wellbore zone;

drawing fluid into the second pump from the second wellbore zone;

pumping fluid from the first pump along a first fluid flow path within the hollow interior; and pumping fluid from the second pump along a second fluid flow path isolated from the first fluid flow path, the second fluid flow path comprising an annulus formed between the deployment tubing and a well casing liner.

15. The method as recited in claim 14, further comprising suspending the first pump in axial alignment with the second pump.

16. The method as recited in claim 14, further comprising powering the first pump and the second pump with an electric motor.

17. The method as recited in claim 14, further comprising powering the first pump with a first electric motor; powering the second pump with a second electric motor; and disposing the first electric motor in axial alignment with the second electric motor.

* * * * *